United States Patent [19]

Martin

[11] 4,096,801

[45] Jun. 27, 1978

[54] REGISTER CONTROL METHOD AND APPARATUS

[76] Inventor: John R. Martin, 2516 Harlem Blvd., Rockford, Ill. 61103

[21] Appl. No.: 430,662

[22] Filed: Jan. 4, 1974

Related U.S. Application Data

[63] Continuation of Ser. No. 222,657, Feb. 1, 1972, abandoned, which is a continuation of Ser. No. 34,798, May 5, 1970, abandoned.

[51] Int. Cl.[2] ..... B41F 13/02; B41J 15/04; B41J 15/16

[52] U.S. Cl. ..... 101/227; 101/228; 101/181; 101/426

[58] Field of Search ..... 101/178–181, 101/219–228, 426; 226/2, 4, 108

[56] References Cited

U.S. PATENT DOCUMENTS

| | | | |
|---|---|---|---|
| 1,688,967 | 10/1928 | Holmes | 101/228 |
| 1,895,842 | 1/1933 | Barber | 226/108 |
| 2,366,331 | 1/1945 | Harless | 101/227 |
| 2,453,982 | 11/1948 | Huck | 101/181 |
| 2,911,908 | 11/1959 | Johnson | 101/181 |
| 2,925,035 | 2/1960 | Crawford | 101/181 |
| 2,972,297 | 2/1961 | Auerbacher | 101/181 |
| 3,098,432 | 7/1963 | Bechtold et al. | 101/181 X |
| 3,174,428 | 3/1965 | Huck | 101/227 |
| 3,179,045 | 4/1965 | Eves | 101/181 |
| 3,280,737 | 10/1966 | Huck | 101/181 |

*Primary Examiner*—J. Reed Fisher
*Attorney, Agent, or Firm*—Fitch, Even, Tabin & Luedeka

[57] ABSTRACT

A method and apparatus for providing or maintaining accurate register of a web with mechanisms operating on the web. The web is driven substantially without slippage at a first position on the web path and a register roller is positioned at a second position on the web path. The register rollers and web are caused to engage without substantial slipping relative to each other. The web is driven at the first position and by the register roller at speeds which have a substantially constant ratio to one another so that web elongation therebetween is substantially constant.

3 Claims, 4 Drawing Figures

REGISTER CONTROL METHOD AND APPARATUS

This is a continuation of copending application Ser. No. 222,657, filed Feb. 1, 1972, now abandoned, which was in turn a continuation of application Ser. No. 34,798, filed May 5, 1970, copending therewith and now abandoned.

This invention relates generally to web register control methods and apparatus and, more particularly, to a method and apparatus for providing or maintaining accurate register of a continuous moving web at the operating positions of two or more mechanisms such as a printing cylinder and a cut-off device, which operates on the web.

A recurring problem in methods and apparatus for processing webs, such as printing presses and associated units, is the control of the register of points along the web with various mechanisms which perform operations on the web. For example in high speed offset printing apparatus in which sheets having repetitive patterns printed thereon are to be cut off and stacked in sheets or folded, the problem of providing accurate register of the printed material with the cutting mechanism is particularly acute. The problem of register control, of course, exists in many contexts such as color printing where ink is applied to the web at successive points along the web path. The present invention is useful in all such contexts and in various printing processes, although it will be described herein in the context of providing cut-off register for a high speed offset printing press.

Conventionally in such methods and apparatus, before reaching the cut-off mechanism the web is engaged by chill rolls and by various pairs of positively driven nip rolls which are each driven at such high speeds that the web is likely to break if there is no slipping between the rolls and the web. Hence the engagement of the rolls and web is made such that some slipping always occurs. Inevitable variation in this slippage causes changes of elongation of the web and consequent changes in register necessitating frequent adjustments such as in the web path length to maintain register before it reaches the cut-off apparatus. This may be done manually or may require complex sensing and feed back devices. Inherently this approach cannot provide completely accurate register control since the response of the operator or the feedback devices cannot be instantaneous.

By contrast, in the present invention, methods and means are provided to drive the web at various points at speeds having substantially constant speed ratios without slippage yet without breakage, thus permitting inherent accurate register control without the complex apparatus conventionally employed.

Accordingly, it is an important object of this invention to provide a method and apparatus for improved web register control.

Another object of the invention is to provide web register control apparatus which controls the elongation of the web directly rather than indirectly through control of the tension in the web.

Yet another object of the invention is to provide web register control apparatus in which the web is in tension throughout its path and is driven without slippage yet without breaking.

A further object of the invention is to provide web register control apparatus which does not require drive means which are variable in relative speed.

A specific object of the invention is to provide improved register of a web with a cut-off apparatus in a high speed printing press.

Other objects of the invention will become apparent from the following description and the accompanying drawings in which.

Figures 1, 2, 3, 4:
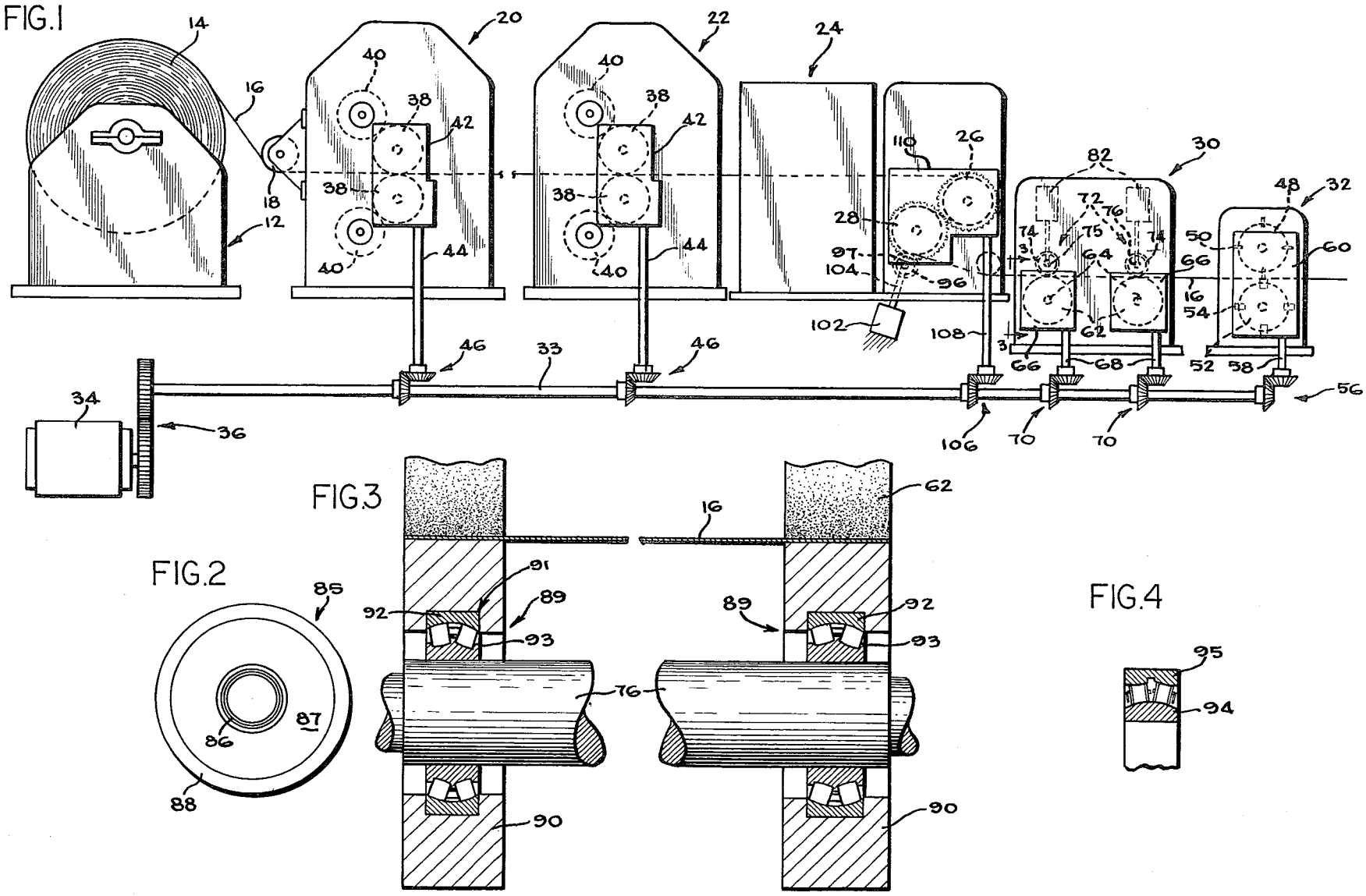
FIG. 1 is a schematic side elevational view of web processing apparatus showing various features of the invention.
FIG. 2 is a side view of one form of the trolley or idler rollers shown in FIG. 1.
FIG. 3 is a partially broken away view of another form of the idler rollers and associated register rollers taken along line 3—3.
FIG. 4 is a fragmentary cross-sectional view similar to FIG. 3 of still another form of idler roller.

Very generally, a web processing system such as is illustrated in FIG. 1 includes a roll stand 12 on which is mounted a web supply roll 14. Web 16 unwinds from the supply roll and passes around a guide roll 18 into and through two successive printing units 20 and 22. After the printing operation is performed and web 16 passes through drying oven 24 and serpertinely around chill rolls 26 and 28. Thereafter it passes through a final drive unit 30 and thence to cut-off mechanism 32. All of the driven elements, i.e., the printing units, chill rolls, final drive unit and cut-off mechanism are driven from a main drive shaft 33. The drive shaft in turn is driven by a motor 34 through gear system 36.

It will be appreciated that the entire processing system could be much longer and more complex than illustrated. For example the web path could be much more complex and the system could include numerous additional guide and driving rolls, additional printing units, tension regulators, lateral guides, sensors, and the like, all of various conventional designs.

More specifically, as illustrated, each of the printing units 20 and 22 includes a pair of impression cylinders 38 and a pair of plate cylinders 40 from which images are repetitively transferred to the impression cylinders. The images are then transferred repetitively to both sides of the web 16 from the impression cylinder. As illustrated, impression cylinders 38 in each printing unit are driven by gear system 42 connected to the main drive shaft by connecting rod 44 and bevel gears 46. Other specific means for driving the impression cylinders at fixed, predetermined speeds are, of course, well known. In any event, the impression cylinders drive the web essentially without slipping. The tangential speed of the impression cylinders and the speed of the web as it leaves the last pair of impression cylinders may be called the press exit speed and may be designated $V_o$.

The solvents in the ink on the printed web 16 are then evaporated from the web by passing it through the drying apparatus 24. In most cases, the dryer is a gas fueled device in which a gas flame comes in direct contact with both sides of the web. As might be expected, such apparatus can cause highly unpredictable changes in the moisture content and shrinkage in the web which not only depend upon the operating parameters of the dryer but also depend upon the characteristics of the portion of the web affected. The nature and quantative aspects of such changes is not completely understood and usually must be empirically determined for each installation as well as for different webs used in the same installation but having varying qualities.

After drying, the web is wrapped serpentinely around successive chill rolls 26 and 28 which are offset from one another, each contacting one side of the web. The chill rolls are large diameter rollers through which cold water is circulated to cool the web and thereby set the ink on the web. As is the case with the dryer the effects of the chill rolls on elongation of the web and other characteristics are highly variable and unpredictable. The chill rolls are driven rollers which also drive the web.

In conventional apparatus the chill rolls are ordinarily driven from the main drive shaft through a variable speed drive system such as the Link Belt Company's positive infinitely variable drive. Such a system is normally adjusted manually. It has been thought previously that such a variable drive system for the chill rolls is essential to good web handling. As will later be seen, the present invention can make possible the elimination of such complexities.

After cooling the web passes through the final drive unit which delivers the web to the cut-off mechanism 32 and provides a final web speed which may be designated as $V_d$. As schematically illustrated the cut-off mechanism includes a rotating knife cylinder 48 on which are mounted a plurality of knives 50. On the opposite side of the web 16 from the knife cylinder is a back-up cylinder 52 provided with spring loaded anvil members 54. As illustrated, both of the cylinders are driven from the drive shaft 33 through bevel gears 56, connecting rod 58 and gear system 60. The anvil members and knives are so spaced on their respective cylinders as to simultaneously engage the web and cooperate in repetitive cutting of the web. Other conventional cut-off mechanisms could also be used.

Normally the respective lengths of the web path between the impression cylinders and chill rolls and between the chill rolls and the final drive unit are much greater than the length of web path between the final drive unit and the cut-off cylinder. Indeed each of the first two mentioned lengths may typically be between 20 feet and 30 feet while the last length may typically be between 12 inches and 18 inches. The disparity makes it possible to treat the problem of establishing register at the cut-off mechanism, in theory, as one of establishing register at the final drive unit, since variations between the last two units are usually negligible.

Before reaching the cut-off mechanism, as previously noted, the web is driven by the final drive unit 30. The desired function of this unit is to provide precise register of the repetitive printed images on the web with the cut-off knives. In the conventional apparatus designed for a folder delivery, such apparatus usually comprises nip rolls. These include relatively smooth surfaced steel discs mounted on shafts on each side of the web. Ordinarily there are two symmetrically positioned discs on each shaft adjacent the edges of the web. The nip rolls are drive by the drive shaft at a predetermined speed. The distance between the shafts on opposite sides of the web relative to the discs' diameters and the web thickness is such that, in combination with the smooth surface of the disc, there is an amount of slipping of the web at the nip. It has been believed for many years in the high speed printing art, that the speed of the web through the nip rolls must vary with different papers and different conditions. This variable web speed has been provided by slippage of the web relative to the nip rolls. To provide this slippage nip rolls are provided which are driven at such high speeds that if slipping were eliminated, the web would break. The teaching of this invention is to the contrary.

Another form of delivery to the cut-off mechanism is a sheeter delivery. The present invention is equally applicable to such a delivery. In a conventional sheeter delivery, the steel discs of a folder delivery on one shaft are replaced by knurled rollers while the discs on the other shaft are replaced by rubber covered wheels which are spring loaded to press the web against the knurled rollers. As in a folder delivery system, the engagement of the wheels or rollers on opposite sides of the web is such as to provide an amount of web slippage.

One important feature of the present invention is to provide an improved means of register control for the web by suitable modification of the final drive unit. An additional important feature of the invention is to also suitably modify other driving mechanisms in a web handling system so as to eliminate the need for the complex feedback and variable drive systems of the prior art.

To these ends the illustrated embodiment of the present invention includes a final drive unit 30 in advance of but close to the cut-off device 32 along the web path and remote from the last printing unit 22 and after the drying unit 24 and chill rolls 26 and 28. The final drive unit or register control apparatus 30 includes sets of register rollers 62, each set being mounted on a shaft 64 positioned on one side of the web. Although a plurality of such roller sets are illustrated, spaced successively along the web path, in many cases a single set of register rollers would be sufficient. A plurality of sets of register rollers are useful, however, as will be seen below, in situations where the web is inhomogeneous and has a modulus of elasticity which varies.

The register rollers 62 are each driven at substantially fixed speeds, as illustrated, by gear systems 66 connected to rotating connecting rods 68 which in turn are driven by the main drive shaft at substantially constant predetermined speeds through respective bevel gear systems 70. The tangential speed of the last register roller set may be designated as $V_f$ while those of prior register rollers may be designated respectively as $V_{f-1}$, $V_{f-2}$, etc.

Associated with each set of register rollers 62 are engagement means 72 for causing the register rollers to engage the web without slipping of the web relative to the register rollers. This feature contrasts with the prior art where slippage has been deemed essential. As illustrated this means 72 includes non-driven idler or trolley rollers 74 on the opposite side of the web 16 from each of the register rollers. The idler rollers are rotatably mounted on shafts 76, connected to the framework of the system. The trolley rollers are forced against the web with sufficient force as to cause the web and register rollers to engage one another without slippage of the web relative to the register roller surface. In order for the web to engage the register roller without slippage the idler or trolley rollers must be capable of applying a sufficiently high force to the web and register rollers despite variations in web thickness or in the regularity of the roller surfaces. In effect this means that the trolley roller system must be compliant, i.e. its actual position relative to the register roller may vary in order to maintain the force. As illustrated this is accomplished by pneumatic air cylinders 82 which actuate a connecting rod 84 connecting to the idler roller shafts 76.

In order for the web to be driven without slippage and without wrinkling or breaking, there must also be a substantially uniform contact of the full face of the idler roller with the web. This is made difficult due to the precise alignments ordinarily required and changes in the shaft alignments. The end may be accomplished by providing compliance of the idler roller face. One form of idler roller which accomplishes this end is illustrated in FIG. 2. As there shown an appropriate idler roller may comprise a wheel 85 with bearings 86, a rim 87 and an outer coating 88 of a resilient deformable substance such as polyurethane which is capable of engaging the web without slipping but will not cause the web to break.

Another form of idler roller is shown in FIG. 3 wherein the rollers comprise hard surfaced wheels 89 of a material such as steel, With such wheels, however, to provide compliance and to prevent web breakage self-aligning bearings 91 are provided for the idler rollers for connection to shaft 76. As shown in FIG. 3 such bearings may be double row self aligning bearings with an outer raceway 92 on a spherical curve and an inner raceway 93 on a cylindrical curve. Alternatively as shown in FIG. 4, the inner raceway 94 may be spherical and the outer raceway 95 cylindrical. Such hard-surfaced idler rollers may be advantageous in that they can withstand higher operating forces then resilent surfaced materials. In connection with this form of roller it may be advantageous to provide hard or non-deformable surfaced register rollers with surfaces which have been roughened, as by sand blasting, to provide greater traction or frictional forces. This may, in some cases provide the advantage that smooth surface nip rolls of a conventional drive unit may be merely so modified.

Since the register rollers are thus enabled to drive the web without slipping, the web velocities as the web leaver the sets of register rollers and trolley rollers will be the same as the tangential speeds of the register roller sets, i.e., $V_{f\cdot 1}$, $V_{f\cdot 2}$, etc. It is an important feature of the present invention that these respective speeds are such that the web is in tension throughout its path and is elongated or stretched by a small amount, which is within its elastic limit so as to prevent breaking between the last impression cylinder, where the velocity is $V_o$ and each successive register roll. Naturally the exact speeds may differ between one installation and another and even between different webs in the same installation. In all cases, however, the respective ratios between successive speeds, i.e., $V_f$, $V_o$, $V_f$, $V_{f\cdot 1}$, etc., are substantially constant. This characteristic makes possible the use of simple direct drive means such as that illustrated interconnecting the drive shaft and the register rollers and eliminates or greatly reduces the need for the manual operation or sensing and feed-back devices to adjust the register.

From the prior discussion it may be seen that there are two important changes from conventional apparatus in the apparatus as described thus far. Firstly, there is no slippage of the web relative to the register rollers. Secondly, the register roller tangential speed and, hence, the web speeds at each register roller and the last impression cylinder have substantially constant ratios to one another, rather than being independently variable.

As a result of the lack of slippage, the relative amount of elongation or stretch of the web between two driving rollers (including both register rollers and impression cylinders) may be determined directly from the ratios of the tangential velocities of the various rollers. This makes it possible to directly determine the time or phase at which any given point or image printed on the web will arrive at a given position relative to the cut-off mechanism. However, since the ratios of tangential velocities are substantially constant, the difference between the phases of repetitive images will also be constant. As a practical matter, since there are operations in most web systems which both tend to shrink and tend to stretch the web, a ratio $V_f$: $V_o$ of approximately 1 has proved to be appropriate in many cases. The practical range of variations has been of the order of $\pm$ 0.1% to $\pm$ .2% as contrasted with prior variations of 1% to 2%.

The foregoing discussion has assumed that the web has a uniform modulus of elasticity throughout its length. This is not usually the case although the effects of such variations are often negligible. If substantial non-uniformities occur, while the average register with the cut-off mechanism will be accurate, individual instantaneous variations may occur. Such effects may be minimized by the utilization of additional sets of register rollers and idler rollers along the web path so that successive sets define shorter web spans within which the web is substantially uniform. As previously noted, one such additional set is illustrated in the drawings.

A surprising consequence of the system as described thus far, is that is makes possible further modification to existing systems to simplify their construction and operation. As illustrated in FIG. 1, this improvement comprises providing the last one of the chill rolls 28 with a cooperating nondriven trolley or idler roller 96 on the opposite side of the web 16 from the chill roll 28. As with the trolley rollers 74, it is rotatably mounted on a shaft 97 which is connected to the framework of the system. Similarly this trolley roller is forced against the web to cause the web and chill rolls to engage one another without slipping by air cylinders 102 and connecting rods 104. The chill rolls 26 and 28 as illustrated are driven directly from the drive shaft 33 through bevel gears 106, connecting rod 108 and gear system 110 which drive the chill rolls 26 and 28. Thus the chill rolls may be considered a single drive point. The trolley roller engages the web near the point of tangency where the web tension is lowest and also where the images have been set to prevent marking. Of course, other forms of direct drives such as timing belts could also be used for the chill rolls, as well as the register and impression rolls.

The variable drive for the chill rolls previously deemed essential has thus been eliminated and the ratios of the tangential velocities of the chill rolls and web velocity upon leaving the chill rolls to the web velocities at the impression cylinders and register rollers are substantially constant. It may be seen therefore that the chill rolls also function in the same manner as the previously described register rollers and the term "register rollers" is to be construed broadly to include chill rolls so constructed and arranged.

Thus it may be seen that the present invention provides accurate register control without using the complex control systems of the prior art and, indeed, in practice, has been shown to provide improved register control at less cost. The teachings of the invention are contrary to the prior art teachings which have insisted that a web cannot be driven without slippage, that such slippage must be precisely and continuously controlled and that variable speeds are required at the chill rolls.

Various changes and modifications may be made in the invention without departing from its scope; for example a plurality of superpositioned webs could be processed by the system. Various features of the invention are set forth in the accompanying claims.

What is claimed is:

1. In a rotary printing press having at least a first printing station, means for feeding a web continuously to the first printing station, and a cut-off mechanism for severing the web spaced downstream from the first printing station by a substantial predetermined distance, apparatus for automatically maintaining accurate registry of successive operations performed upon the web including printing at the first printing station and severing by the cut-off mechanism without sensing position and feeding back a position signal to control means to maintain registry, said apparatus comprising a plurality of driven rolls for engaging the web at respective spaced positions along its path of travel from the first printing station to the cut-off mechanism, engagement means for causing all of said driven rolls to engage the web at respective ones of said positions without slippage therebetween, said engagement means including means for forcing the web against at least the last of said driven rolls before the cut-off mechanism with force sufficient to preclude slippage therebetween, and motive means for driving all of said driven rolls at respective tangential speeds bearing substantially constant ratios to one another so that the elongation of the web between respective driven rolls is substantially constant, the ratios of speeds being such that the web is maintained in tension without breaking between driven rolls.

2. The apparatus of claim 1 wherein one of said driven rolls is a chill roll following the first printing station and preceding the last of said driven rolls, and said engagement means includes means for forcing the web against said chill roll with force sufficient to preclude slippage therebetween.

3. For a rotary printing press having at least a first printing station, means for feeding a web to the first printing station, and a cut-off mechanism for severing the web spaced downstream from the first printing station by a substantial predetermined distance, the method for automatically maintaining accurate registry of successive operations performed upon the web including printing at the first printing station and severing by the cut-off mechanism without sensing position and feeding back a position signal to maintain registry, said method comprising engaging the web with driven rolls at a plurality of respective spaced positions along its path of travel from the first printing station to the cut-off mechanism, causing all of said driven rolls to engage the web at respective ones of said positions without slippage therebetween, including forcing the web against at least the last of said driven rolls before the cut-off mechanism with force sufficient to preclude slippage therebetween, and elongating the web between driven rolls by substantially constant amounts by driving all of said driven rolls at respective tangential speeds bearing substantially constant ratios to one another, the ratios of speeds being such that the web is maintained in tension without breaking between driven rolls.

* * * * *